US011226105B2

(12) United States Patent
Erbe et al.

(10) Patent No.: US 11,226,105 B2
(45) Date of Patent: Jan. 18, 2022

(54) COOKING APPLIANCE COMPRISING A RECEIVING AREA FOR A REMOVABLE SENSOR MODULE

(71) Applicant: BSH Hausgeräte GmbH, Munich (DE)

(72) Inventors: Sebastian Erbe, Knittlingen-Freudenstein (DE); Arnulf Himmel, Traunreut (DE); Dan Neumayer, Bernau (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 259 days.

(21) Appl. No.: 16/485,926

(22) PCT Filed: Feb. 9, 2018

(86) PCT No.: PCT/EP2018/053269
§ 371 (c)(1),
(2) Date: Aug. 14, 2019

(87) PCT Pub. No.: WO2018/153690
PCT Pub. Date: Aug. 30, 2018

(65) Prior Publication Data

US 2020/0025389 A1 Jan. 23, 2020

(30) Foreign Application Priority Data

Feb. 21, 2017 (DE) ..... 10 2017 202 778.9

(51) Int. Cl.
*F24C 7/08* (2006.01)
*F24C 15/04* (2006.01)

(52) U.S. Cl.
CPC ..... *F24C 7/085* (2013.01); *F24C 15/04* (2013.01)

(58) Field of Classification Search
None
See application file for complete search history.

(56) References Cited

U.S. PATENT DOCUMENTS

2007/0133344 A1* 6/2007 Bronstering ..... F24C 7/085 366/146
2008/0295489 A1* 12/2008 Elfvik ..... F01N 9/007 60/277

(Continued)

FOREIGN PATENT DOCUMENTS

DE 102007048834 A1 4/2008
DE 102008043722 A1 * 5/2010 ..... F24C 15/02

(Continued)

OTHER PUBLICATIONS

International Search Report PCT/EP2018/053269 dated Apr. 25, 2018.

*Primary Examiner* — Jason Lau
(74) *Attorney, Agent, or Firm* — Michael E. Tschupp; Andre Pallapies; Brandon G. Braun

(57) ABSTRACT

A cooking appliance, in particular a baking oven, includes a cooking compartment for cooking food to be cooked, and a door for closing the cooking compartment in an operating position, with the door having a receptacle. Arranged in the door is a sensor module for identifying a property of the food to be cooked when the door assumes the operating position. The sensor module is receivable in the receptacle and reversibly removable from the receptacle.

18 Claims, 2 Drawing Sheets

(56) References Cited

U.S. PATENT DOCUMENTS

| | | | | |
|---|---|---|---|---|
| 2015/0330640 | A1 | 11/2015 | Stork et al. | |
| 2017/0000292 | A1* | 1/2017 | Park | H04N 5/2257 |
| 2017/0336077 | A1* | 11/2017 | Danzer | F24C 15/04 |
| 2018/0003395 | A1* | 1/2018 | Reinhard-Herrscher | F24C 7/086 |
| 2018/0094820 | A1* | 4/2018 | Verdoliva | F24C 15/025 |

FOREIGN PATENT DOCUMENTS

| | | | |
|---|---|---|---|
| EP | 0269955 | A2 | 6/1988 |
| EP | 2515044 | A1 | 10/2012 |
| KR | 20140039733 | A | 4/2014 |

* cited by examiner

COOKING APPLIANCE COMPRISING A RECEIVING AREA FOR A REMOVABLE SENSOR MODULE

CROSS-REFERENCES TO RELATED APPLICATIONS

This application is the U.S. National Stage of International Application No. PCT/EP2018/053269, filed Feb. 9, 2018, which designated the United States and has been published as International Publication No. WO 2018/153690 A1 and which claims the priority of German Patent Application, Serial No. 10 2017 202 778.9, filed Feb. 21, 2017, pursuant to 35 U.S.C. 119(a)-(d).

BACKGROUND OF THE INVENTION

The invention relates to a cooking appliance comprising a cooking compartment for cooking food to be cooked.

A cooking appliance having a camera for observing the food to be cooked is known from the document DE102007048834A1. The disadvantage of this solution is that the camera is exposed to the high temperatures in the baking oven. Accordingly, the maximum temperature of the baking oven is substantially limited to the maximum temperature of the camera, so that operating modes demanded by the user, such as e.g. hot air at 300° C. for pizza or pyrolytic self-cleaning at 500° C., are not possible.

BRIEF SUMMARY OF THE INVENTION

Object of the invention is to improve the operation of sensors in the food to be cooked, in particular to arrange the sensor securely in the cooking appliance such as to meet the user demands for a cooking appliance, such as e.g. pyrolytic self-cleaning, as well as for the environmental requirements for sensors, such as e.g. maximum temperature, and to ensure these in all operating modes.

The invention is based on a cooking appliance, in particular a baking oven, including a cooking compartment for cooking food to be cooked, a door to close the cooking compartment in an operating position, and a sensor module arranged in the door for identifying properties of the food to be cooked when the door assumes the operating position. A cooking appliance shall be understood in particular as a baking oven, a microwave appliance, or a steamer, which is suitable for cooking food to be cooked in the form of foodstuffs to render it appropriate for consumption. A door shall be understood in particular as the closure element which separates the cooking compartment from the surrounding environment of the cooking appliance. Preferably, for this purpose, a door is used which touches the cooking compartment in a horizontally or vertically rotatable manner and is able to pivot in a rotatory manner between an opened, so-called "open position", and a closed, so-called "operating position". A sensor module shall be understood in particular as an electronic component having sensors for identifying properties and conditions of the food to be cooked.

It is proposed that the door has a receptacle, from which the sensor module is reversibly removable. A receptacle shall be understood in particular as a container, preferably configured as a pocket, which is suitable for receiving and storing the sensor module. "Reversibly removable" shall be understood to relate in particular to the capability by the end customer to remove the sensor module without tools in such a way that it can be removed from the cooking appliance non-destructively and inserted back into the receptacle again. This constructive configuration enables an operation of the cooking appliance with use of the sensor module in the range of cooking temperatures lying below critical operating temperatures of the sensor module, and at the same time an operation of the cooking appliance with removed sensor module at cooking compartment temperatures lying above the critical temperatures of the sensor module. Thus, it is possible to ascertain the properties of food to be cooked during temperature-noncritical temperatures of the cooking appliance and to remove the sensor module at higher temperatures, such as e.g. a pyrolytic self-cleaning of the cooking appliance. The receptacle ensures hereby a secure retention of the sensor module and positions the sensor module in the best possible location in relation to the food to be cooked.

Preferably, the receptacle is accessible in an open position of the door and/or is not accessible in the operating position of the door. An open position of the door shall be understood in particular as the position of the door in which the cooking compartment is reachable in such a manner as to enable loading with food to be cooked with the door facing the user. This results in the advantage that, in the open position of the door, the receptacle is arranged such as to be freely accessible for the user and the sensor module thus can be conveniently inserted into the receptacle or removed from the receptacle. In the closed operating position of the door, the receptacle is concealed by components of the cooking appliance such that the receptacle becomes inaccessible and the sensor module may neither be insertable nor removable. Possible components which cover the receptacle would be the control panel above the door, or strips situated to the side of the door, what are known as "lesenes".

Preferably, the receptacle is arranged between an inner pane of the door and an outer pane of the door. A door on the cooking appliance includes, inter alia, at least one door pane, preferably several door panes and in particular two door panes. These door panes differ in particular in their mounting position in relation to the cooking compartment. An inner pane of the door shall be understood in particular as the door pane which is closest to the cooking compartment in the operating position. An outer pane of the door shall be understood in particular as the door pane which is arranged furthest from the cooking compartment in the operating position. When the receptacle for the sensor module is situated between the inner and outer panes, the inner pane protects both the receptacle and the sensor module from the heat of the cooking compartment to a sufficient extent and the outer pane protects both the receptacle and the sensor module from soiling and environmental impacts, such as e.g. damages. When the door includes more than two panes, the receptacle and the sensor module are preferably arranged between the inner pane and the subsequent intermediate panes.

Preferably, the receptacle is arranged in or on a top panel of the door or in or on a side panel of the door. A top panel shall be understood in particular as a strip-shaped element, which is arranged horizontally on the upper end of the door pane which upper end faces the user. The top panel serves hereby as a cover element, which secures the door panes against removal and keeps contamination from migrating between the door panes. A side panel shall be understood in particular as a strip-shaped element, which is arranged vertically on the left and right edges of the door panes. The side panel serves as frame element, which guides and/or retains the door panes on the side and keeps contaminations from migrating between the door panes. The attachment of the receptacle for the sensor module on the top panel or side panel is particularly advantageous, as these locations are particularly easily accessible for the user when the door is open and provide adequate ventilation or cooling, thereby ensuring the functional safety of the sensor module. The lateral insertion of the sensor module into the side panel or the insertion of the sensor module into the top panel from above takes place when the door is at least partially ajar.

The receptacle is preferably arranged in a cooling air stream of the door. A cooling air stream shall be understood as referring in particular to the air exchange via older ambient air in the door, which air exchange serves to prevent the high temperatures of the cooking compartment from reaching the outer pane of the door via the inner pane and further door components. For this purpose, an air volume is blown through a gap out of the door or into the door by a motor having an impeller and arranged in the cooking appliance. By way of a cooling air stream of this kind, an undesired rise in the front temperature of the cooking appliance front and thus the risk of burns for the user is avoided. In order to also protect the sensor module from the high temperatures of the cooking compartment, it is advantageous to position the receptacle for the sensor module in relation to the door such that the present cooling air stream cools the receptacle or the sensor module situated therein or transports heat away. For this purpose, it is particularly advantageous to provide the receptacle with holes, so that the air stream reaches the sensor module situated therein.

Preferably, the receptacle is in contact with at least one cooling body. A cooling body shall be understood in particular as an element which, due to its material and/or its mass, is suitable to absorb excess heat or to dissipate heat away from the object to be cooled. For this purpose, in particular the front of the door, the outer pane, or the door handle is suitable. Alternatively, the cooling body may also be an actively cooling element, such as e.g. a cooling unit. When the receptacle interacts with such a cooling body, both the generated heat of the sensor module and the undesired waste heat of the cooking compartment, which strains the sensor module, can be dissipated via the receptacle to the cooling element, thereby positively affecting both the measuring quality of the sensor and the service life thereof.

Preferably, the receptacle has at least one housing element, in particular for protecting the sensor module from soiling or environmental impacts. A housing element shall be understood in particular as an enclosure which surrounds and fixes the sensor module and is suitable for protecting the sensor module from environmental impacts, such as shaking or dirt, sufficiently well.

Preferably, the receptacle has at least one means for fastening the sensor module in the receptacle in a manner which is preferably releasable without tools, wherein this fastening is particularly based on a snap-fit connection or a push-pull mechanism. As a result of this configuration of the receptacle, the user is enabled to remove the sensor module from the cooking appliance without the assistance of tools, or to insert it again. Thus the need for elaborate auxiliary tools and wearing parts can be eliminated.

Preferably, the area of the receptacle facing the cooking compartment in the operating position of the door has a functional surface, in particular a reflective coating, which is preferably recessed in the region of a beam path of the sensor. In order to protect both the receptacle and the sensor module situated therein from heat, the surface of the receptacle, which surface faces the cooking compartment, has a coating which reflects the thermal radiation. In order to avoid the functionality of the sensor to be adversely affected, this coating has a recess in the region of the beam path of the sensor.

Preferably, the receptacle has an electrical interface, in particular for the transmission of data and/or electrical energy. An electrical interface shall relate in particular to the link which is arranged between two systems and provides their exchange. The exchange is realized in the form of physical (e.g. electrical voltage, current intensity) or logical variables (data) and can be established in an analog or digital manner. A receptacle embodied in such a manner may both supply the sensor module with electrical voltage, in particular for operating the sensor, and also receive and forward information of the sensor module in the form of image material. Thus, for example, it is possible to query whether the sensor module has been removed from the receptacle, before a temperature-critical self-cleaning process is started.

Preferably, the sensor module has at least one sensor, which preferably is an optical sensor, in particular a camera, an NIR sensor and/or a pyrometer. Optical sensors of this kind are particularly suitable for capturing properties and conditions of the food to be cooked, wherein the camera can capture images, an NIR sensor can detect the category of foodstuff, or a pyrometer can determine the temperature.

Preferably, the outer pane or an intermediate pane has a cover, in particular a printed section, which conceals the receptacle as well as the sensor module toward the outer side of the door. A cover shall be understood in particular as an obscuring layer, which is suitable for hiding in particular the receptacle as well as the sensor module from the sight of the user in such a way that the user does not see the components, but rather the cover, preferably the printed section.

Preferably, at least the inner pane has a surface coating, in particular a reflective surface coating, which is recessed in the region of the beam path of the sensor. In order to protect both the receptacle and the sensor module situated therein from heat, the inner pane, preferably on the side which faces the cooking compartment, has a coating which reflects the thermal radiation. In order to avoid the functionality of the sensor to be adversely affected, this surface coating has a recess in the region of the sensor.

Preferably, the inner pane, in particular in the region of the beam path of the sensor, has a layer or a coating with a high degree of transparency for the sensor-specific wavelength. In order to prevent the inner pane, which protects the sensor module and the receptacle from high temperatures, from adversely affecting the measurement result of the sensor, the inner pane has a layer or a coating, preferably with low light refraction, by way of which the beam path of the sensor can be established largely unobstructed and measurement tolerances are as low as possible.

Preferably, the cooking appliance has a detector system, which ascertains the presence of the sensor module in the receptacle, wherein the detector system preferably ascertains the presence via the current consumed by the sensor module or via an end position of a lock hook. A detector system shall be understood in particular as a device, which is suitable for ascertaining the presence of the sensor module in the receptacle. The determination of the presence of the sensor module can be established by querying the necessary operating voltage of the sensor module. One alternative makes provision for the detector system to query the end position of an appliance-side lock hook. When the latter is able to pivot into its end position during its preferably rotatory rotational movement, then no sensor module is present in the receptacle. When this lock hook is unable to pivot into its end position, the sensor module has been inserted into the receptacle.

Preferably, a cooking appliance control is configured such as to permit different operating modes as a function of the presence of the sensor module in the receptacle. An appliance control shall be understood in particular as the program which controls the operating modes as well as temperatures in the cooking appliance. The appliance control queries the user or directly the detector system as to the presence of the sensor module in the receptacle and in dependence thereof permits or declines the operating modes thereof, such as self-cleaning, identification of food to be cooked, temperature measurement, etc. Thus, when a sensor module is situated in the receptacle, a pyrolytic cleaning process is not permitted and, when the sensor module is not situated in the receptacle, a pyrolytic cleaning process is permitted.

BRIEF DESCRIPTION OF THE DRAWINGS

Further features of the invention will become apparent from the figures and the description of the figures. The features and combinations of features mentioned in the description above and the following features and combinations of features mentioned in the description of the drawings and/or shown in the drawings alone are usable not only in the respective combination given, but also in other combinations or taken alone without departing from the scope of the invention. Exemplary embodiments of the invention which are not explicitly shown in the schematic figures and described, but which arise and can be created through separate combinations of features from the embodiments described are therefore also to be considered as included and disclosed. It is shown in.

DETAILED DESCRIPTION OF EXEMPLARY EMBODIMENTS OF THE PRESENT INVENTION

Figure 1:
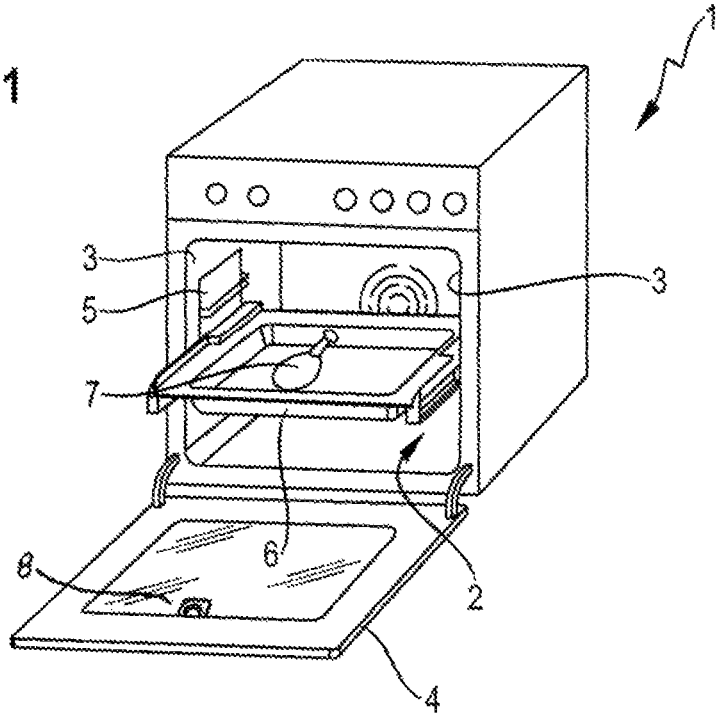
FIG. 1 a schematic perspective representation of a cooking appliance.

In the figures, same or functionally identical elements are provided with the same reference characters.

FIG. 1 shows a perspective representation of a cooking appliance 1 for preparing foodstuffs, which, in the exemplary embodiment, is a baking oven. The cooking appliance 1 includes a cooking compartment 2, which is delimited by side walls 3 of the oven. At its front, the cooking compartment 2 has a loading opening, which can be closed by a door 4. Situated on the side walls 3 are side rails 5, respectively, which are suitable for receiving carriers 6 for food to be cooked, such as e.g. racks or trays, on which the food 7 to be cooked rests. For identifying the properties of the food 7 to be cooked, a sensor module 8 is provided in the door 4. This installation position has proved to be particular effective, as it is closest to the usual viewing angle of the user into the cooking appliance 1 or at the food 7 to be cooked.

Figure 2:
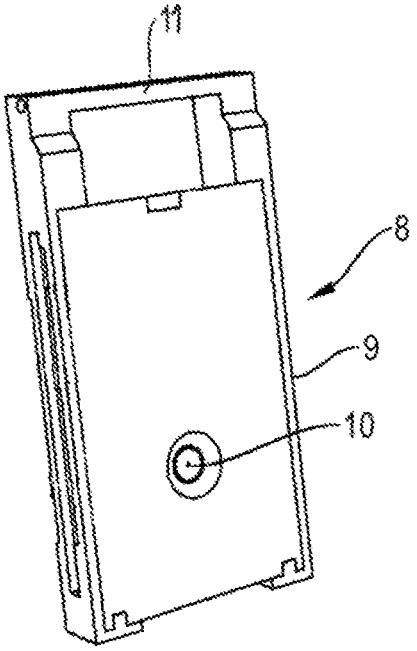
FIG. 2 a schematic perspective representation of a sensor module.

FIG. 2 shows a perspective representation of the sensor module 8 configured in the form of a camera. The sensor module has a housing 9, wherein a sensor 10 arranged therein is arranged in the region of a recess of the housing 9 so as to be able to observe through this recess the food to be cooked. In the exemplary embodiment shown, the sensor 10 is embodied as an optical sensor, in order to capture image information, particularly in the form of a digital image or a video stream. The housing 9 has a handle element 11, with the aid of which the sensor module 8 can be removed from the cooking appliance 1. Thus, the user of the cooking appliance 1 can remove the sensor module 8 situated in the installation position from the cooking appliance without tools.

Figure 3:
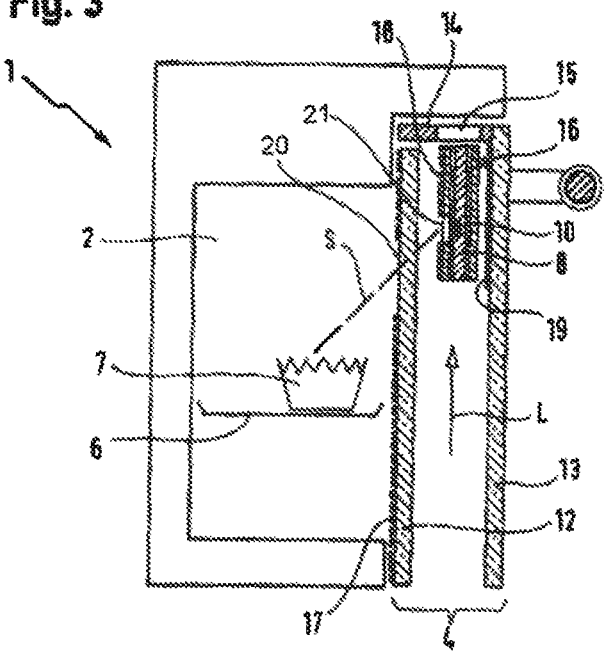
FIG. 3 a schematic sectional representation of a cooking appliance.

FIG. 3 shows a schematic sectional representation of a cooking appliance 1 as well as the door 4 thereof, in the operating position. The door 4 has two door panes which extend in substantially parallel relation to one another, with the inner pane 12 facing the cooking compartment 2 and the outer pane 13 facing away from the cooking compartment 2. To cover the panes 12, 13, a top panel 14 is attached to the upper end of the panes 12, 13. This top panel 14 has an opening 15, through which the sensor module 8 is placed into a receptacle 16. The receptacle 16 is hereby arranged between the two panes 12, 13 such that the sensor 10 has a clear view of the food 7 to be cooked with its beam path S. An air stream L between the inner pane 12 and the outer pane 13 is effective to lower the front temperature on the outer pane 13 and is used simultaneously to cool the sensor module 8. To protect the receptacle 16 as well as the sensor module 8, the inner pane 12 has a coating 17, which reflects the infrared radiation back into the cooking compartment 2. Moreover, the receptacle 16 has a coating 18 on its side facing the cooking compartment 2, which coating reflects the infrared radiation back into the cooking compartment 2. Both the coating 17 and the coating 18 have recesses 20, 21 to keep the beam path S clear. The outer pane 14 has a coating 19, which covers the sensor module 8 such that the sensor module 8 is not visible for the user from outside when the door 4 assumes the operating position.

Figure 4:
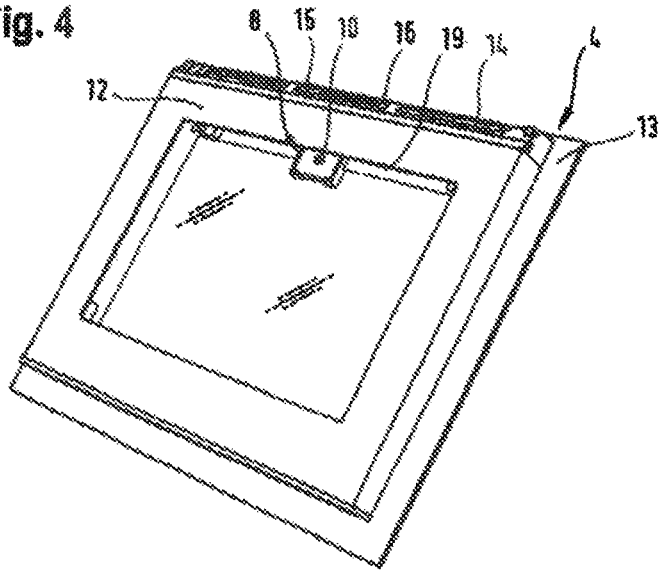
FIG. 4 a schematic perspective representation of the sensor module in a preferred installation position.

FIG. 4 shows the sensor module 8 in its installation position in the receptacle 16 when the door 4 is opened. The top panel 14 has hereby an opening 15, which is cleared when the door 4 is opened and configured for insertion or removal of the sensor module 8 between the panes 12, 13. The installation position of the sensor module 8 in the door 4 is selected such as to provide the sensor 10 with a clear view of the food 7 to be cooked. In the exemplary embodiment, the receptacle 16 and the top panel 14 are embodied in one piece.

The person skilled in the art will appreciate that the invention is not limited to the exemplary embodiment shown, but rather covers a multitude of variants and modified versions as well.

The invention claimed is:

1. A cooking appliance, in particular a baking oven, comprising:

a cooking compartment for cooking food;

a door configured to close the cooking compartment in an operating position, the door having a receptacle;

a sensor module arranged in the door and configured to identify a property of the food when the door assumes the operating position, the sensor module being receivable in the receptacle and reversibly removable from the receptacle; and a cooking appliance controller configured to allow different operating modes based on a presence of the sensor module in the receptacle, wherein the cooking appliance controller is configured to:

prohibit a pyrolytic cleaning process when the sensor module is received in the receptacle, and permit the pyrolytic cleaning process when the sensor module is removed from the receptacle.

2. The cooking appliance of claim 1, wherein the receptacle is accessible when the door assumes an open position and wherein the receptacle is not accessible when the door assumes the operating position.

3. The cooking appliance of claim 1, wherein the receptacle is arranged between an inner pane of the door and an outer pane of the door.

4. The cooking appliance of claim 1, wherein the receptacle is arranged in or on a top panel of the door or in or on a side panel of the door.

5. The cooking appliance of claim 1, wherein the receptacle is arranged in an air stream for cooling the door.

6. The cooking appliance of claim 1, wherein the receptacle is in contact with at least one cooling body.

7. The cooking appliance of claim 1, wherein the receptacle includes a housing element for protecting the sensor module from contamination or environmental impacts.

8. The cooking appliance of claim 1, wherein the receptacle includes a snap-fit connection or a push-pull mechanism to releasably fasten the sensor module in the receptacle without tools.

9. The cooking appliance of claim 1, wherein the receptacle has an area which faces the cooking compartment in the operating position of the door and defines a functional surface comprising a reflective coating.

10. The cooking appliance of claim 9, wherein the functional surface is recessed in a region of a beam path emitted from the sensor.

11. The cooking appliance of claim 1, wherein the receptacle includes an electrical interface for transmission of data and/or electrical energy.

12. The cooking appliance of claim 1, wherein the sensor module is an optical sensor module and includes an optical sensor.

13. The cooking appliance of claim 12, wherein the optical sensor is a camera, an NIR sensor and/or a pyrometer.

14. The cooking appliance of claim 1, further comprising a cover provided on an outer pane or an intermediate pane of the door and configured to conceal both the receptacle and the sensor module to an outer side of the door.

15. The cooking appliance of claim 1, wherein the door includes an inner pane having a surface coating which is recessed in a region of a beam path emitted from the sensor.

16. The cooking appliance of claim 15, wherein the surface coating is a reflective surface coating.

17. The cooking appliance of claim 1, wherein the door includes an inner pane having a layer or coating which is transparent for a sensor-specific wavelength at least in a region of a beam path emitted from the sensor.

18. The cooking appliance of claim 1, further comprising a detector system, configured to ascertain a presence of the sensor module in the receptacle based on a current consumed by the sensor module or an end position of a lock hook.

* * * * *